US005081747A

United States Patent [19]

Takizawa et al.

[11] Patent Number: 5,081,747

[45] Date of Patent: Jan. 21, 1992

[54] SLIDE FASTENER SLIDER

[75] Inventors: Toshiaki Takizawa, Kurobe; Yutaka Tominaga, Toyama, both of Japan

[73] Assignee: Yoshida Kogyo K.K., Tokyo, Japan

[21] Appl. No.: 591,277

[22] Filed: Oct. 1, 1990

[30] Foreign Application Priority Data

Oct. 2, 1989 [JP] Japan ..... 1-115935[U]

[51] Int. Cl.[5] ..... A44B 19/26

[52] U.S. Cl. ..... 24/415; 24/427

[58] Field of Search ..... 24/415, 416, 385, 427, 24/428, 498, 576, 587, 115 L, 516

[56] References Cited

U.S. PATENT DOCUMENTS 2,496,820 2/1950 Smith .
2,997,765 8/1961 Moghadam ..... 24/427
3,189,038 6/1965 von Pechmann ..... 24/115 L
3,848,298 11/1974 Frohlich ..... 24/427

FOREIGN PATENT DOCUMENTS 0280339 8/1988 European Pat. Off. .
507975 9/1930 Fed. Rep. of Germany .
1040474 10/1958 Fed. Rep. of Germany .
0325618 6/1936 Italy ..... 24/427
171339 11/1934 Switzerland .
1150784 4/1969 United Kingdom .

*Primary Examiner*—Victor N. Sakran
*Attorney, Agent, or Firm*—Hill, Van Santen, Steadman & Simpson

[57] ABSTRACT

A slide fastener slider comprises a pair of upper and lower wings joined integrally together at its front end by a diamond; and a pair of flanges disposed between the upper and lower wings and converged towards the rear end of the slider to thus define with the diamond a Y-shaped guide channel for running of fastener element rows therethrough. The slider further includes a plurality of large-diametered guide rollers rotatably mounted thereon for rolling engagement with the fastener element rows. The slider is specifically constructed such that there remain open spaces around the guide rollers, so that stringer tapes is quite immune from being stuck in the guide rollers.

12 Claims, 6 Drawing Sheets

SLIDE FASTENER SLIDER

BACKGROUND OF THE INVENTION

1. Field of the Invention

The present invention relates generally to a slider for slide fasteners, and more particularly to a slider to be used on slide fasteners which require an extremely great force so as to open and close the same, such as a large-sized slide fastener or a heavy-duty slide fastener for industrial use.

2. Description of the Prior Art

A slide fastener of the type described has suffered from drawbacks that there intrinsically arises considerable frictional resistance between the slider and interlocking fasteners elements reciprocating therethrough. The frictional resistance not only renders the reciprocation of the slider quite sluggish but also causes frictional abrasion on a guide channel of the slider, thus leading the slider to mulfunction even for a short period. For solving such a difficulty, West German Patent No. 1040474 proposes an attempt of providing a pair of guide rollers one in each of the opposed guide flanges.

This attempt has overcome the difficulty to some extent but it still remains unsatisfactory. In the conventional slider, the guide rollers are mostly embedded in the guide flanges with their respective parts exposed for rolling engagement with the respective fastener element rows running through the guide channel of the slider. Since the guide flanges themselves are very thin, the guide rollers embedded therein are very small in diameter as well. Since being minute in diameter, the guide rollers are very liable to stick in spaces between adjacent fastener elements of the mating element fastener element rows, so that the slider is prevented from smooth reciprocation along the fastener element rows.

Mere replacement of the small-diametered guide rollers with rollers of larger diameter would not result in solution of the difficulty. Since the guide rollers are mounted beside a junction portion of the Y-shaped guide channel where stringer tapes of the slide fastener are inclined to pucker or wrinkle during the reciprocation of the slider along the fastener element rows; if the guide rollers were large in diameter, the puckers of the stringer tapes are the more susceptible to be caught by and between the guide rollers and the guide flanges, thus obstructing the reciprocation of the slider.

SUMMARY OF THE INVENTION

With the foregoing difficulties in view, it is therefore an object of the present invention to provide a slide fastener slider in which are provided guide rollers large enough to ensure smooth reciprocation of the slider along fastener element rows.

It is another object of the present invention to provide a slide fastener slider in which its stringer tapes, even if puckered, are quite immune from being caught in the slider which reciprocates along fastener element rows of the slide fastener.

According to one aspect of the present invention, there is provided a slide fastener slider adapted for being reciprocally movable along two rows of interlocking fastener elements mounted on the inner longitudinal edges of a pair of stringer tapes of a slide fastener, the slider comprising a pair of upper and lower wings joined integrally together at its front end by a diamond; a pair of guide flanges provided between the upper and lower wings and converged towards the rear end of the slider to thus define with the diamond a Y-shaped guide channel for running of the fastener element rows therethrough, the upper wing having a pair of lateral extensions one provided beyond the outer side of each flange; and a pair of guide rollers rotatably mounted one on each extension and disposed one on each side of the junction portion of the Y-shaped guide channel for rolling engagement with the fastener element rows, the lower wing being slightly less in width than the Y-shaped guide channel at least adjacent the junction portion of the Y-shaped guide channel so that there remain open spaces below the guide rollers.

According to another aspect of the present invention, there is provided a slide fastener slider adapted for being reciprocally movable along two rows of interlocking fastener elements mounted on the inner longitudinal edges of a pair of stringer tapes of a slide fastener, the slider comprising a pair of upper and lower wings joined intergrally together at its front end by a diamond; a pair of guide flanges provided between the upper and lower wings and converged towards the rear end of the slider to thus define with the diamond a Y-shaped guide channel for running of the fastener element rows therethrough, each of the upper and lower wings having a pair of lateral extensions one provided beyond the outer side of each flange, and two pairs of guide rollers rotatably mounted on the respective extensions and disposed one pair on each side of the junction portion of the Y-shaped guide channel for rolling engagement with the fastener element rows, each guide roller being disposed at an angle relative to the mating guide roller opposed thereto across the fastener tape in such a manner that the confronting surfaces of the opposed rollers diverge outwardly of the slider.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
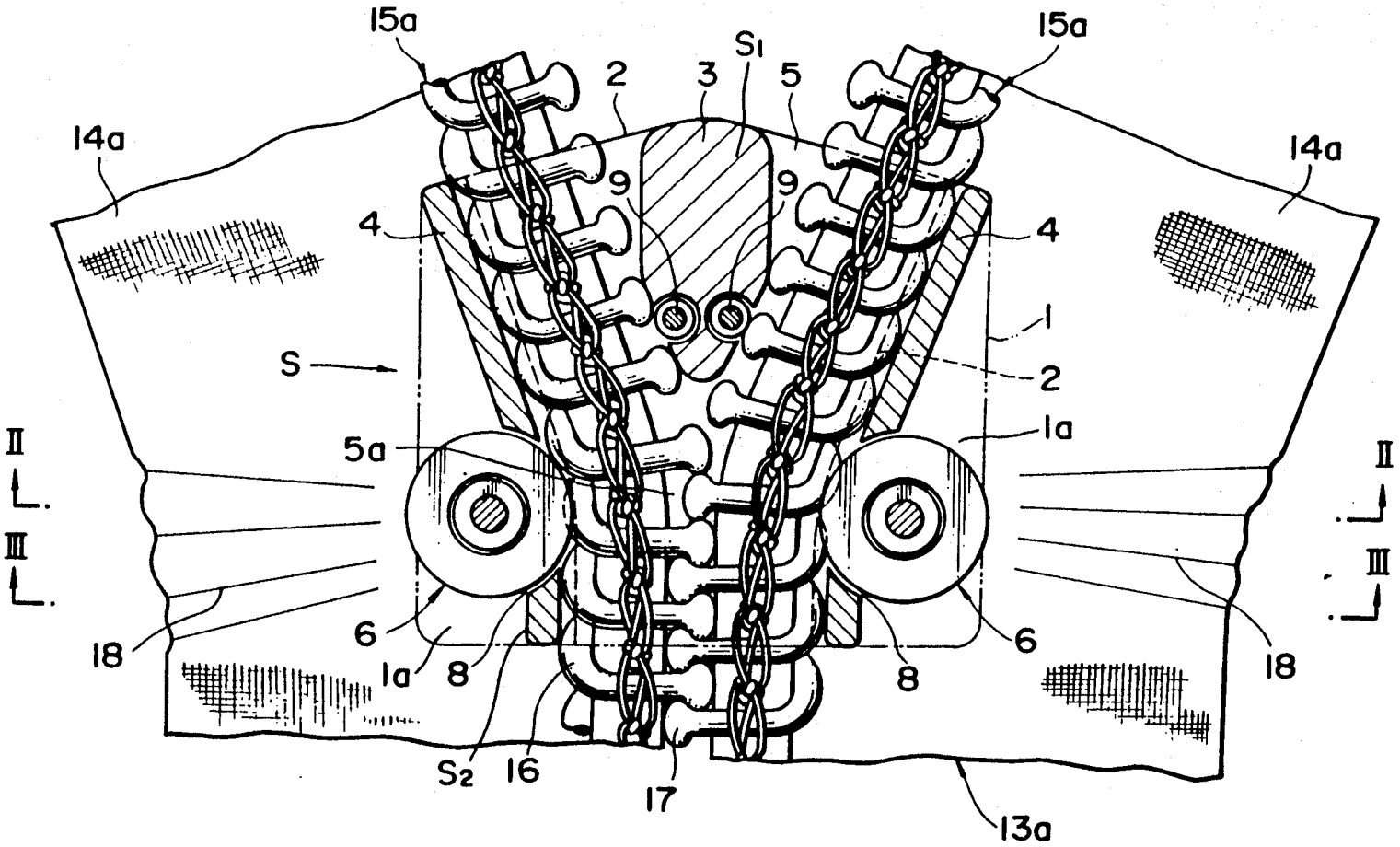
FIG. 1 is a cross-sectional view taken on line I—I of FIG. 2, showing a slider according to the first embodiment of the present invention.
Figure 2:
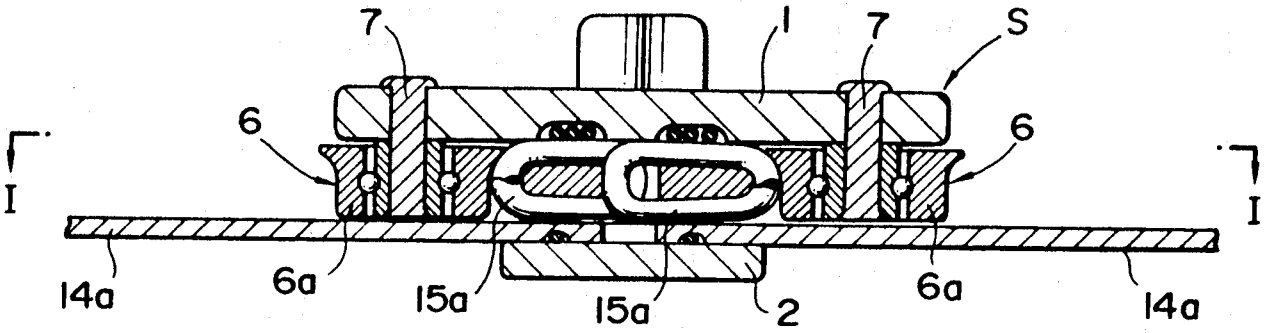
FIG. 2 is a cross-sectional view taken on line II—II of FIG. 1.
Figure 3:
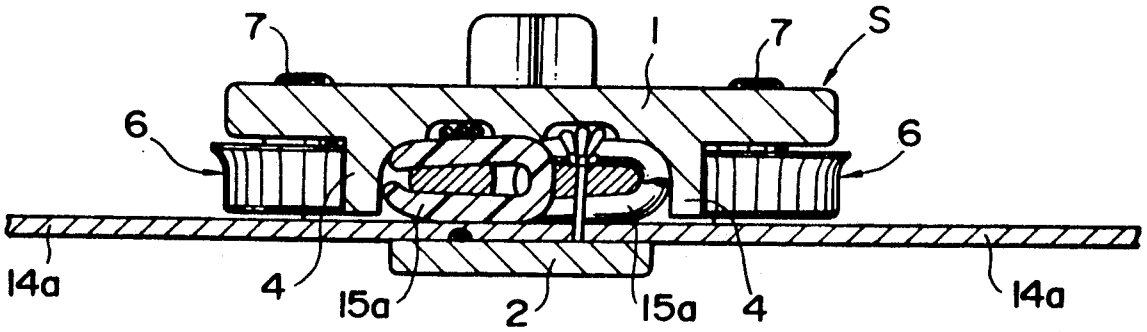
FIG. 3 is a cross-sectional view taken on line III—III of FIG. 1.

FIGS. 1 through 3 shows a slide fastener slider S according to the first embodiment of the present invention. The slider S constitute a part of a slide fastener 13*a*, which comprises, in addition to the slider S, a pair of stringer tapes 14*a* and two rows of coiled interlocking fastener elements 15*a* mounted on the respective inner longitudinal edges of the stringer tapes 14*a*. The slider S is reciprocally mounted on the two rows of fastener elements 15*a*, as better shown in FIG. 1.

As shown in FIGS. 1 through 3, the slider S comprises a pair of upper and lower wings 1, 2 disposed in spaced parallel relation to each other and joined integrally with each other at its front end S1 by a diamond or a central neck portion 3. The upper wing 1 has on its inner surface a pair of opposed lateral flanges 4, 4 one mounted on each side thereof and converged towards the rear end S2 of the slider S. The converged lateral flanges 4, 4 define with the diamond 3 a Y-shaped guide channel 5 through which the fastener element rows 15*a* are running. The lower wing 2 is substantially similar in shape to but slightly less in width than the Y-shaped guide channel 5. As indicated by phantom lines in FIG. 1, the upper wing 1 is substantially rectangular but has its front end protrude slightly forwards at the diamond 3. The upper wing 1 has a pair of lateral extensions 1*a* 1*a*, one provided beyond the outer side of each flange 4. As shown in FIG. 1, the flanges 4 has a pair of openings 8 formed one on each side of a junction portion 5*a* of the Y-shaped channel 5, in which junction portion 5*a* the two rows of coupling elements 15*a* start to couple with each other, as the coupling element rows 15*a* slide down through the slider S. As shown in FIGS. 1 and 2, a pair of guide rollers 6, 6 are rotatably mounted, via their respective axles 7, one on each lateral extension 1*a* of the upper wing 1, with their respective peripheries partly projecting through the openings 8 toward each other for rolling engagement with the fastener element rows 15*a* which are passing through the junction portion 5*a* of the Y-shaped guide channel 5. This means that the guide rollers 6, 6 are advantageously disposed at the most effective positions to guide the fastener element rows 15*a*, 15*a*. The guide rollers 6 are in the shape of a ball bearing or a roller bearing. As shown in FIG. 2, the outer race 6*a* of the guide roller 6 has a radius of curvature large enough to touch on the respective link portions 16 of each adjacent elements 15*a* so as to ensure that the guide roller 6 never stick into a space between two adjacent fastener elements 15*a*. As better shown in FIG. 2, the outer periphery of the outer race 6*a* of the guide roller 6 is preferably complementary in contour with the link portion 16 of the fastener element 15*a*.

As mentioned earlier, since the upper wing 1 has a pair of the lateral extensions 1*a*, 1*a* provided one on each side of the Y-shaped guide channel 5 while the lower wing 2 is slightly less in width than the Y-shaped guide channel 5, there remains open space below the guide rollers 6, 6 mounted on the lateral extensions 1*a*, 1*a*, as shown in FIGS. 2 and 3. Even if the guide rollers 6 projected outwardly beyond the side edges of the upper wing 1, the guide rollers 6, themselves would have no trouble; however, since the projecting parts of the guide rollers 6 would be likely to objectionably impinge or catch extraneous objects, the guide rollers 6 should not project outwardly beyond the side edges of the upper wing 1.

Furthermore, as shown in FIG. 1, a pair of auxiliary rollers 9, 9 are rotatably embedded one in each side of the diamond 3 with their respective parts exposed for rolling engagement with the coupling head portions 17 of the fastener element rows 15*a* running through the Y-shaped guide channel 5.

Figure 4:
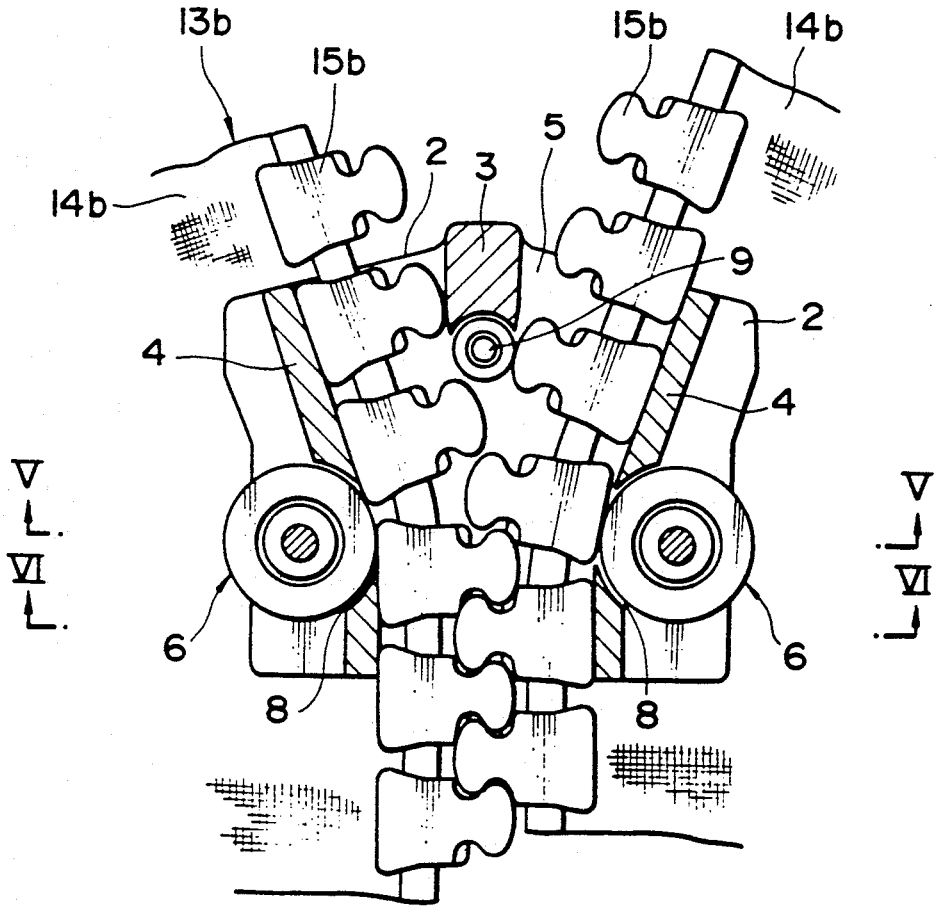
FIG. 4 is a cross-sectional view taken on line IV—IV of FIG. 5, showing a slider according to the second embodiment of the present invention.
Figure 5:
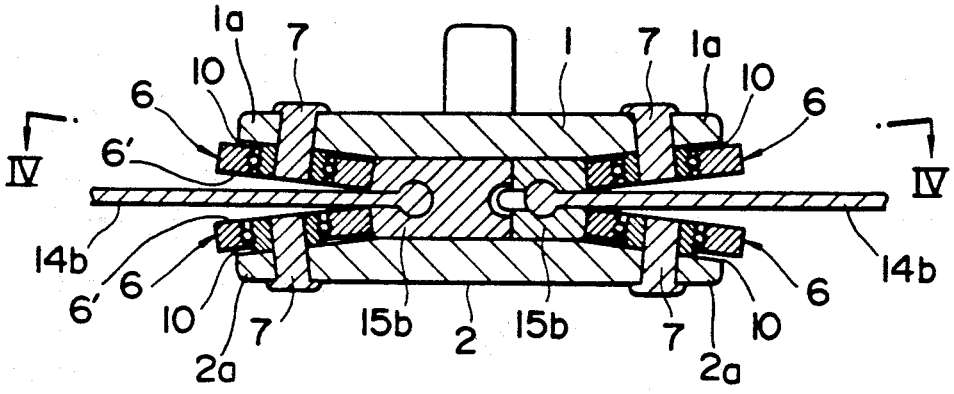
FIG. 5 is a cross-sectional view taken on line V—V of FIG. 4.
Figure 6:
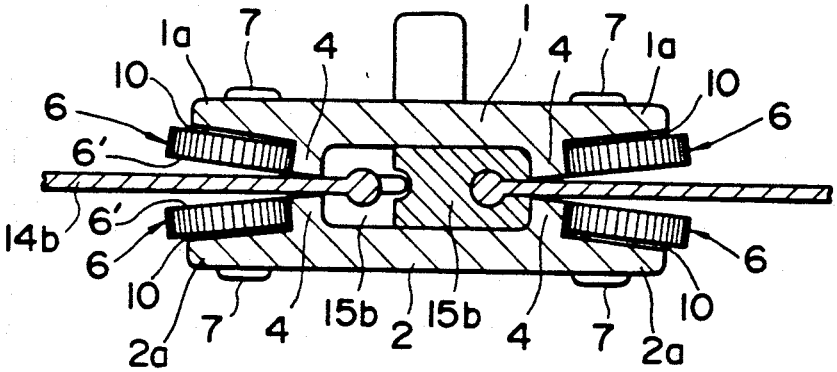
FIG. 6 is a cross-sectional view taken on line VI—VI of FIG. 4.

FIGS. 4 through 6 show a slide fastener slider S according to the second embodiment of the present invention. Instead of coiled fastener elements 15*b* in the preceding embodiment, a slide fastener 13*b* according to the second embodiment has two row of discrete injection-molded interlocking fastener elements 15*b* mounted on the respective inner longitudinal edges of the stringer tapes 14*b*. Unlike the upper and lower wings 1, 2 of the preceding embodiment, the upper and lower wings 1, 2 are substantially identical in size and shape with each other. As shown in FIG. 6, the upper and lower wings 1, 2 have their respective pairs of flanges 4, 4 on their opposed inner surfaces, each converged towards the rear end S2 of the slider S, which flanges 4, 4 define a Y-shaped guide channel 5 with the diamond 3, as better shown in FIG. 4. As shown in FIGS. 5 and 6, each of the upper and lower wings 1, 2 have a pair of lateral extensions 1*a*, 1*a*; 2*a*, 2*a*, one provided beyond the outer side of each flange 4. Two pairs of guide rollers 6, 6 are rotatably mounted, via their respective axles 7, 7; 7, 7, on their respective lateral extensions 1*a*, 1*a*; 2*a*, 2*a* of the upper and lower wings 1, 2, with part of the guide rollers 6, 6; 6, 6 projecting through the openings 8 for rolling engagement with the fastener element rows 15*b*. The openings 8 are formed one on each side of the junction portion 5*a* of the Y-shaped guide channel 5 as in the first embodiment. It is to be noted that each extension 1*a*, 2*a* has a beveled inner surface 10 and that each guide roller 6 is disposed at an angle relative to the mating guide roller 6 opposed thereto across the fastener tape 14*b* in such a manner that the confronting surfaces 6′ of the roller opposed guide rollers 6, 6 diverge outwardly. A single auxiliary guide roller 9 is rotatably mounted on the rear end of the diamond 3. The auxiliary guide roller 9 is of such a diameter as to ensure that the guide roller 9 never touch interlocking fastener elements 15*b* of both left and right fastener element rows at one and the same time.

Figure 7:
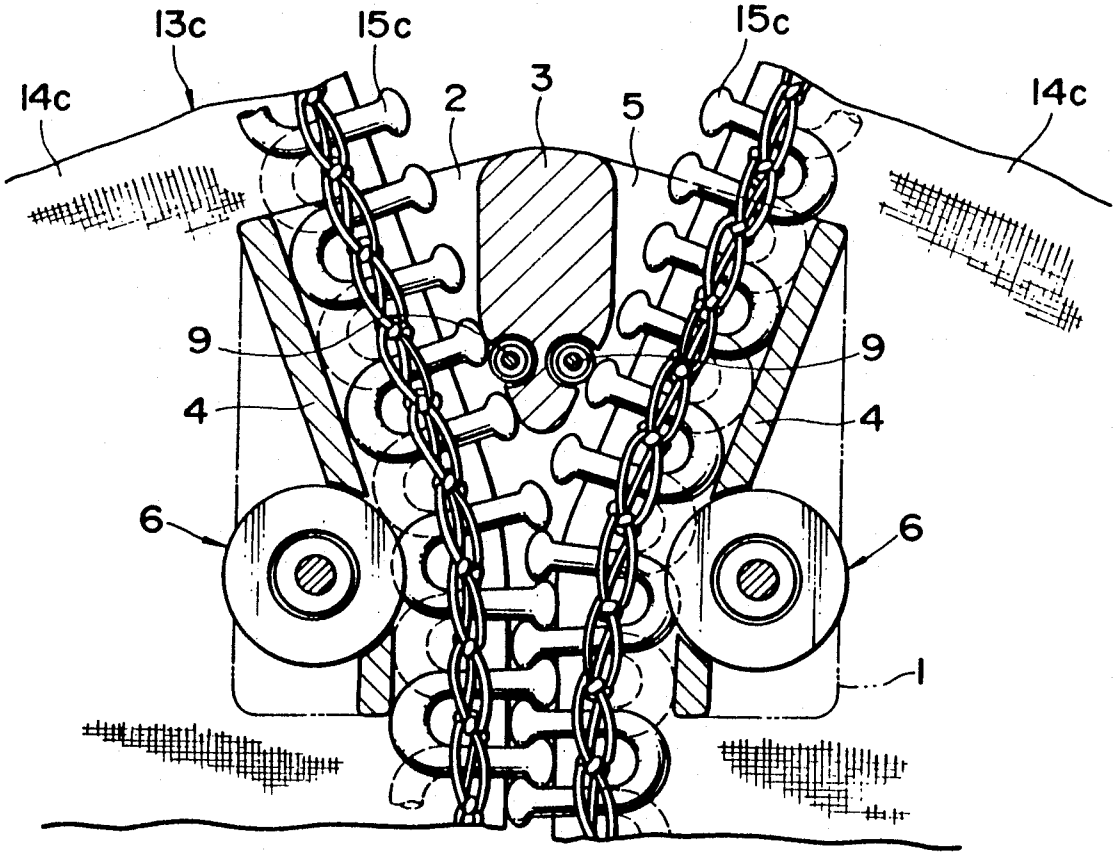
FIG. 7 is a view similar to FIG. 4 but shows a slider according to the third embodiment of the present invention.

FIG. 7 shows a slide fastener slider S according to the third embodiment of the present invention. The slider S is reciprocally mounted on two rows of meander type interlocking fastener elements 15*c* which rows are, in turn, mounted on the inner longitudinal edges of a stringer tapes 14*c* of a slide fastener 13*c*. The slider S according to the third embodiment is substantially identical, in construction, with that illustrated in FIG. 4, with the exception that the diamond 3 has a pair of auxiliary guide rollers 9, 9, one embedded in each side thereof like that in the first embodiment.

Figure 8:
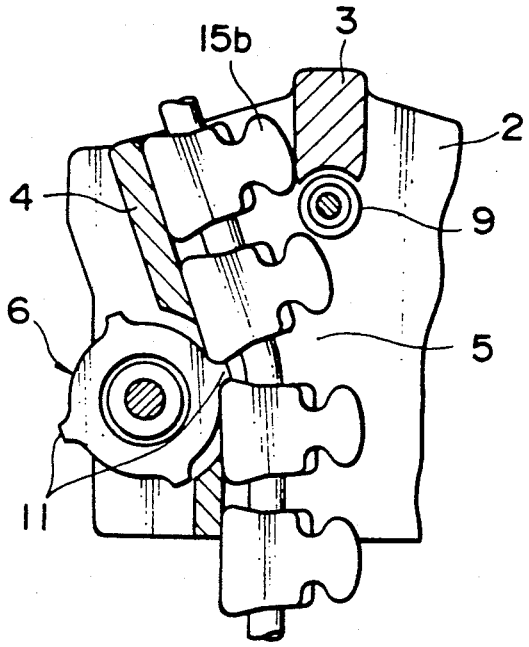
FIG. 8 is a fragmentary cross-sectional view of a invention.

FIG. 8 shows a slide fastener slider S according to the fourth embodiment of the present invention. The slider S is substantially identical with that illustrated in FIG. 4, with the exception that a plurality of axial ridges 11 are provided on the periphery of each of the guide rollers 6 at uniform intervals which conform with a pitch between each adjacent interlocking elements 15*b*. As the slider S reciprocates along the fastener element rows 15*b*, the axial ridges 11 progressively engage the fastener elements 15*b*, so that the ridged guide rollers 6 are rolling over the fastener element rows 15*b* reliably and retentively.

Figure 9:
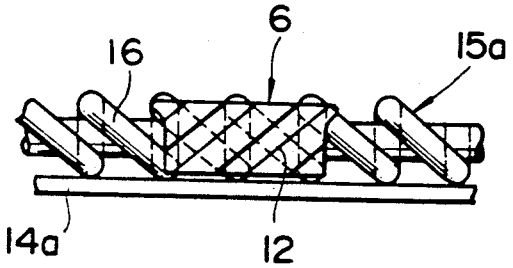
FIG. 9 is a side elevational view of a still another embodiment of the present invention, showing a guide roller engaging with a fastener element row.

FIG. 9 shows another embodiment of the present invention. In this embodiment, a guide roller 6 has around its periphery a succession of slant grooves 12 which conform in contour with the slant link portions 16 of the coiled interlocking fastener elements 15*a* shown in FIG. 1.

Preferably, each of the guide rollers 6 has a layer of rubber wrapped around its periphery or has roulettes formed around its periphery in order to ensure that, as the slider S reciprocates along the fastener element rows 15*b*, the guide rollers 6 are rolling retentively and reliably on the fastener element rows 15*b*.

Reference numeral 18 in FIG. 1 denotes puckers or wrinkles formed on and adjacent the outer longitudinal edge of the stringer tapes 14*a*. The slider S may be made in a unitary construction by die-casting or the upper and lower wings 1, 2 and the diamond 3 may be first die-casted separately and then joined together with bolts or other fastening means.

With the construction of the slider according to the present invention, even if puckers are formed on the stringer tapes, the puckers are quite immune from getting stuck in between the guide rollers and the lower wings.

Furthermore, since the guide roller is large in diameter enough to ensure that it does not stick in a space between the adjacent elements, the fastener element row can be guided smoothly around the guide roller, which means that the slider can reciprocate along the the fastener element rows very smoothly.

Obviously, various modifications and variations of the present invention are possible in light of the above teaching. It is therefore to be understood that within the scope of the appended claims the invention may be practiced otherwise than as specifically described.

What is claimed is:

1. A slide fastener slider adapted for being reciprocally movable along two rows of interlocking fastener elements mounted on the inner longitudinal edges of a pair of stringer tapes of a slide fastener, the slider comprising a pair of upper and lower wings joined integrally together at its front end by a diamond; a pair of guide flanges provided between the upper and lower wings and converged towards the rear end of the slider to thus define with the diamond a Y-shaped guide channel for running of the fastener element rows therethrough, the upper wing having a pair of lateral extensions one provided beyond the outer side of each flange; and a pair of guide rollers rotatably mounted one on each extension and disposed one on each side of the junction portion of the Y-shaped guide channel for rolling engagement with the fastener element rows, the lower wing being slightly less in width than the Y-shaped guide channel at least adjacent the junction portion of the Y-shaped guide channel so that there remain open spaces below the guide rollers.

2. A slide fastener slider according to claim 1, further including an auxiliary roller rotatably mounted on the diamond for rolling engagement with coupling head portions of the fastener element rows.

3. A slide fastener slider according to claim 1, each guide roller having a plurality of axial ridges formed around its periphery at uniform intervals which conform with a pitch between each adjacent interlocking elements.

4. A slide fastener slider according to claim 1, each guide roller having around its periphery a succession of slant grooves which conform in contour with link portions of the fastener elements.

5. A slide fastener slider according to claim 1, each guide roller having a layer of rubber wrapped around its periphery.

6. A slide fastener slider according to claim 1, each guide roller having roulettes formed around its periphery.

7. A slide fastener slider adapted for being reciprocally movable along two rows of interlocking fastener elements mounted on the inner longitudinal edges of a pair of stringer tapes of a slide fastener, the slider comprising a pair of upper and lower wings joined integrally together at its front end by a diamond; a pair of guide flanges provided between the upper and lower wings and converged towards the rear end of the slider to thus define with the diamond a Y-shaped guide channel for running of the fastener element rows therethrough, each of the upper and lower wings having a pair of lateral extensions are provided beyond the outer side of each flange, and two pairs of guide rollers rotatably mounted on the respective extensions and disposed one pair on each side of the junction portion of the Y-shaped guide channel for rolling engagement with the fastener element rows, each guide roller being disposed at an angle relative to the mating guide roller opposed thereto across the fastener tape in such a manner that the confronting surfaces of the opposed rollers diverge outwardly of the slider.

8. A slide fastener slider according to claim 7, further including an auxiliary roller rotatably mounted on the diamond for rolling engagement with the fastener element rows.

9. A slide fastener slider according to claim 7, each guide roller has a plurality of axial ridges formed around its periphery at uniform intervals which conform with a pitch between each adjacent interlocking elements.

10. A slide fastener slider according to claim 7, each guide roller having around its periphery a succession of slant grooves which conform in contour with link portions of the fastener elements.

11. A slide fastener slider according to claim 7, each guide roller having a layer of rubber wrapped around its periphery.

12. A slider fastener slider according to claim 7, each guide roller having roulettes formed around its periphery.

* * * * *